US009968160B2

(12) United States Patent
Peyton

(10) Patent No.: US 9,968,160 B2
(45) Date of Patent: May 15, 2018

(54) SOLE ASSEMBLY FOR AN ARTICLE OF FOOTWEAR WITH BOWED SPRING PLATE

(71) Applicant: NIKE, Inc., Beaverton, OR (US)

(72) Inventor: Lee Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 80 days.

(21) Appl. No.: 14/832,339

(22) Filed: Aug. 21, 2015

(65) Prior Publication Data

US 2016/0058123 A1 Mar. 3, 2016

Related U.S. Application Data

(60) Provisional application No. 62/043,481, filed on Aug. 29, 2014.

(51) Int. Cl.
*A43B 13/14* (2006.01)
*A43B 13/00* (2006.01)
*A43B 13/18* (2006.01)

(52) U.S. Cl.
CPC ..... *A43B 13/183* (2013.01); *A43B 13/141* (2013.01)

(58) Field of Classification Search
CPC ... A43B 13/183; A43B 13/185; A43B 13/182; A43B 13/184; A43B 13/10; A43B 13/12; A43B 13/125; A43B 13/127; A43B 13/122; F16F 1/366; F16F 1/368; F16F 1/3683; F16F 1/3686; F16F 1/3737; F16F 1/027; F16F 1/18; F16F 1/182; F16F 1/185; F16F 1/187; F16F 1/26; F16F 15/1215; F16F 15/1336; F16F 2238/022
USPC .... 36/129, 102, 107, 27, 29, 151, 152, 25 R
See application file for complete search history.

(56) References Cited

U.S. PATENT DOCUMENTS 427,136 A * 5/1890 Walker ..... A43B 13/183 36/28
898,084 A * 9/1908 Backermann ..... A43B 5/18 36/7.8
1,172,613 A * 2/1916 Larsen ..... A43B 13/183 36/37
1,297,922 A * 3/1919 Skinner et al. ..... A43B 7/142 36/173

(Continued)

FOREIGN PATENT DOCUMENTS

DE 4015138 A1 11/1991
EP 2491807 A2 8/2012

(Continued)

OTHER PUBLICATIONS

Fiber-reinforced plastic, Wikiipedia, Mar. 22, 2017, https://en.wikipedia.org/wiki/Fibre-reinforced_plastic.*

(Continued)

*Primary Examiner* — Jameson Collier
*Assistant Examiner* — Heather Mangine
(74) *Attorney, Agent, or Firm* — Quinn IP Law

(57) ABSTRACT

A sole assembly for an article of footwear has a curved spring plate that stores and releases spring energy to aid in forward propulsion. The curved spring plate has a center portion and opposite end portions extending from the center portion. A retaining member is secured to the end portions such that the retaining member spans across and bows the center portion. Flexing of the spring plate stores spring energy in the spring plate that urges the center portion to unflex and release the spring energy.

20 Claims, 5 Drawing Sheets

(56) References Cited

U.S. PATENT DOCUMENTS 1,571,073 A * 1/1926 Tapling ..... A63B 25/10 36/114
1,638,350 A * 8/1927 Long ..... A63B 25/10 36/7.8
1,698,003 A * 1/1929 Rieke ..... A43B 7/1465 36/179
1,736,609 A * 11/1929 Letourneau ..... A43B 3/16 36/7.6
2,413,545 A * 12/1946 Lee ..... A43B 5/12 116/67 R
2,527,414 A * 10/1950 Hallgren ..... A43B 13/181 36/32 R
2,814,132 A * 11/1957 Montoscuro ..... A43B 21/32 36/37
3,096,086 A * 7/1963 Krakauer ..... A47C 7/30 267/103
3,219,358 A * 11/1965 Hagner ..... A43B 13/184 280/11.14
3,339,908 A * 9/1967 Komarnitsky ..... F16F 1/02 267/47
3,377,722 A * 4/1968 Downing ..... A43B 13/182 36/7.8
3,444,631 A * 5/1969 MacLeod ..... A63B 25/10 36/7.8
3,685,812 A * 8/1972 Buchesky ..... F16F 1/22 267/47
3,814,410 A * 6/1974 Fukui ..... B60G 9/003 267/47
3,975,005 A * 8/1976 Duchemin ..... F16F 1/185 267/47
4,288,064 A * 9/1981 Austen ..... F16F 1/422 267/159
4,391,048 A * 7/1983 Lutz ..... A43B 1/0036 36/28
4,445,283 A 5/1984 Meyers
4,446,634 A 5/1984 Johnson et al.
4,519,591 A * 5/1985 Bush ..... B29C 69/002 267/148
4,540,197 A * 9/1985 Finn ..... B60G 11/181 267/25
4,556,204 A * 12/1985 Pflederer ..... F16F 1/3686 267/148
4,638,575 A * 1/1987 Illustrato ..... A43B 21/30 36/28
4,707,317 A * 11/1987 Epel ..... B29C 70/081 156/180
4,843,737 A * 7/1989 Vorderer ..... A43B 13/182 36/27
4,881,329 A * 11/1989 Crowley ..... A43B 13/183 36/27
4,910,884 A * 3/1990 Lindh ..... A43B 13/18 36/27
5,098,510 A * 3/1992 Krummenacher .... B29C 53/825 156/433
5,138,776 A * 8/1992 Levin ..... A43B 13/183 36/27
5,141,209 A * 8/1992 Sano ..... B60G 11/08 267/260
5,311,680 A * 5/1994 Comparetto ..... A43B 7/14 36/140
5,517,769 A * 5/1996 Zhao ..... A43B 13/18 36/27
5,528,842 A * 6/1996 Ricci ..... A43B 13/12 36/103
5,706,589 A * 1/1998 Marc ..... A43B 13/18 36/27
5,871,298 A * 2/1999 Lekhtman ..... A43B 13/183 402/77
5,875,567 A * 3/1999 Bayley ..... A43B 13/18 36/27
5,896,679 A * 4/1999 Baldwin ..... A43B 21/30 36/27
5,916,071 A * 6/1999 Lee ..... A43B 13/182 482/124
6,009,636 A * 1/2000 Wallerstein ..... A43B 13/141 36/27
6,338,207 B1 * 1/2002 Chang ..... A43B 13/203 36/28
6,436,012 B1 * 8/2002 Naville ..... A43B 5/00 36/114
6,558,297 B1 * 5/2003 Brown, Jr. ..... A63B 25/08 482/112
6,712,395 B1 * 3/2004 Lee ..... A43B 5/1633 280/11.19
6,928,756 B1 * 8/2005 Haynes ..... A43B 13/183 36/27
7,243,443 B2 7/2007 Swigart
7,334,351 B2 * 2/2008 Hann ..... A43B 13/20 36/102
7,335,138 B2 * 2/2008 Lee ..... A63B 25/08 482/75
7,578,077 B2 * 8/2009 Marc ..... A43B 13/181 36/103
7,748,143 B2 * 7/2010 Mathieu ..... A43B 3/0036 36/3 B
7,950,166 B1 * 5/2011 Perenich ..... A43B 13/141 36/102
8,348,031 B2 * 1/2013 Smaldone ..... A43B 13/183 188/372
8,474,154 B2 7/2013 Werremeyer et al.
8,776,397 B2 7/2014 Borel et al.
9,066,559 B2 * 6/2015 Butler ..... A43B 13/386
9,194,452 B2 * 11/2015 Hawkins ..... F16F 1/3615
9,241,533 B2 * 1/2016 Heard ..... A43B 7/144
9,399,153 B2 * 7/2016 Green ..... A63C 17/0046
9,480,302 B2 * 11/2016 Freschi ..... A43B 13/141
2005/0000115 A1 1/2005 Kimura et al.
2007/0271818 A1 * 11/2007 Rabushka ..... A43B 13/183 36/38
2010/0263228 A1 10/2010 Kang
2012/0324760 A1 * 12/2012 Ochoa ..... A43B 13/183 36/102
2014/0290098 A1 * 10/2014 Loverin ..... A43B 13/026 36/103
2015/0167768 A1 * 6/2015 Zhao ..... F16F 1/368 267/164
2016/0058124 A1 * 3/2016 Lucas ..... A43B 13/183 36/28
2016/0207370 A1 * 7/2016 Moeller ..... B60G 11/08
2016/0214332 A1 * 7/2016 Zhao ..... B29C 70/46
2016/0302521 A1 * 10/2016 Rennex ..... A43B 3/0005
2017/0174029 A1 * 6/2017 Asbeck ..... B60G 11/04

FOREIGN PATENT DOCUMENTS

GB 324242 A 1/1930
JP H04371102 A 12/1992
WO 2010136513 A1 12/2010

OTHER PUBLICATIONS

Translation of EP 2491807A2, Gabor Shoes, Aug. 29, 2012, translated by EPO and Google on Mar. 22, 2017.*

* cited by examiner

SOLE ASSEMBLY FOR AN ARTICLE OF FOOTWEAR WITH BOWED SPRING PLATE

CROSS-REFERENCE TO RELATED APPLICATION

This application claims the benefit of U.S. Provisional Application No. 62/043,481 filed on Aug. 29, 2014, which is hereby incorporated by reference in its entirety.

TECHNICAL FIELD

The present teachings generally include a sole assembly for an article of footwear having a curved spring plate.

BACKGROUND

Footwear typically includes a sole configured to be located under a wearer's foot to space the foot away from the ground or floor surface. Sole structure can be designed to provide a desired level of cushioning. Athletic footwear in particular sometimes utilizes polyurethane foam or other resilient materials in the sole structure to provide cushioning. It is also beneficial for the sole structure of an article of athletic footwear to have a ground contact surface that provides sufficient traction and durability for general use or for a particular athletic endeavor.

DESCRIPTION

Figure 1:
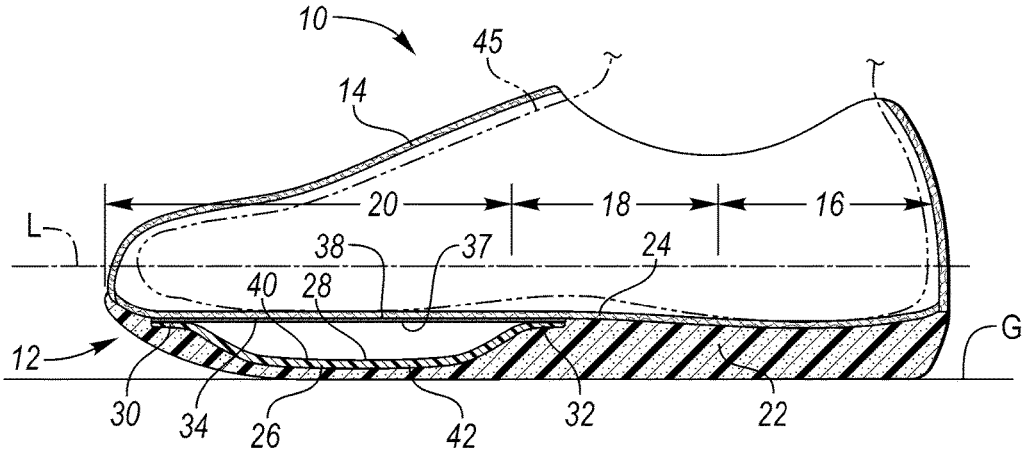
FIG. 1 is a schematic cross-sectional illustration of an article of footwear with a spring plate and in an unflexed position.

A sole assembly for an article of footwear has a curved spring plate that stores and releases spring energy to aid in forward propulsion. The curved spring plate has a center portion and opposite end portions extending from the center portion. The spring plate also has a first side with a first surface and an opposing second side with a second surface. A retaining member is secured to the end portions such that the retaining member spans across and bows the center portion. Flexing (i.e., bending) of the spring plate stores spring energy in the spring plate that urges the center portion to unflex (i.e., unbend) and release the spring energy.

The retaining member is secured to the first surface only at the end portions. A sole layer, such as a midsole layer, may be secured to the second surface of the spring plate at both the end portions and the center portion. The sole layer may have a forefoot portion, a midfoot portion, and a heel portion. The spring plate may be secured to the forefoot portion of the sole layer with a first of the end portions forward of a second of the end portions.

A pre-assembly curvature of the center portion is reversed by attachment of the retaining member. In other words, the center portion has a first curvature when the spring plate is not secured to the retaining member, and has a second curvature opposite in direction from the first curvature when the retaining member is secured to the end portions. Moreover, the center portion has a third curvature greater than the second curvature when the retaining member is secured to the end portions and the spring plate is flexed under loading. Accordingly, as the article of footwear is flexed in moving toward a toe-off position, energy is stored in the spring plate, and when the article of footwear is unflexed to reach the toe-off position, the spring plate releases the stored energy and helps to propel forward movement.

In one embodiment, the retaining member is an inextensible fabric. The spring plate may be a fiber strand-laid composite, a carbon-fiber composite, a thermoplastic elastomer, a glass-reinforced nylon, or another suitable material, such as laminated wood, tempered steel, spring steel, or a material used for an archery or hunting bow. The spring plate may be laminated. In other words, the spring plate may comprise multiple relatively thin layers of the suitable material fixed to one another, each layer generally following and defining the curvature of the spring plate. The layers may have different overall lengths in a longitudinal direction of the article of footwear, as each individual layer need not extend to and include each of the first end portion and the second end portion. Such a laminated construction may increase flexibility of the spring plate in comparison to a spring plate of the same suitable material formed in a single layer. As used herein, a "suitable material" for the spring plate is a material that has a sufficient stiffness in order to store sufficient energy when flexed from the second curvature to the third curvature, so that the spring plate is urged to unflex and release the stored energy to return to the second curvature. The end portions may have a greater bending stiffness than the center portion so that flexing of the spring plate is mainly at the center portion.

The spring plate and the retaining member may define a void (i.e., a cavity) therebetween. In one embodiment, the retaining member is secured only to the first and the second end portions of the spring plate and the void is between the center portion of the spring plate and the retaining member. The retaining member flexes toward the center portion of the spring plate as the spring plate flexes under loading to decrease the void.

The retaining member may be secured to the spring plate by adhesive bonding. One or more clips may also be used to further secure the retaining member to the spring plate at one or both of the end portions. In one embodiment, the clip is crimped to the spring plate. Alternatively, a mechanical lock or an interference locking system may be used to secure the retaining member to the spring plate. In such an embodiment, mechanical anchors secure the retaining member to the spring plate, with each anchor extending through the retaining member and through a respective slot in the spring plate.

In an embodiment, protrusions extend from the first surface of the spring plate at the center portion. The protrusions are configured to be spaced from one another when the center portion has the second curvature. Adjacent ones of the protrusions are configured to contact one another when the center portion has the third curvature, thereby limiting flexing of the spring plate. By way of non-limiting example, in one embodiment, at least some of the protrusions taper toward the retaining member and extend generally transversely across the spring plate. In another example embodiment, at least some of the protrusions extend generally transversely across the spring plate and each have a neck extending from the first surface and a head generally perpendicular to the neck at a terminal end of the neck.

In one embodiment, a sole assembly for an article of footwear includes a midsole layer having a forefoot portion, a midfoot portion, and a heel portion arranged along a longitudinal axis of the midsole layer. A curved spring plate is supported on and secured to the forefoot portion of the midsole layer. The curved spring plate has a center portion and first and second end portions extending from the center portion generally along the longitudinal axis. The center portion has a first bending stiffness and the end portions each have a respective bending stiffness greater than the first bending stiffness. An inextensible retaining member is secured to the end portions such that a pre-assembly curvature of the center portion is reversed and the retaining member spans across and bows the center portion, defining a void between the center portion and the retaining member. Loading of the spring plate and the retaining member when the forefoot portion is flexed stores spring energy in the spring plate that urges the sole assembly forward when the spring energy is released as the forefoot portion unflexes.

The center portion may have a first curvature when the curved spring plate is disassembled from the retaining member and the midsole layer, and the center portion may have a second curvature opposite in direction from the first curvature when the retaining member is secured to and spans across the center portion, and the sole assembly is in a first unflexed state. The center portion may have a third curvature greater than the second curvature when the spring plate is secured to the midsole layer, the retaining member is secured to and spans across the center portion, and the sole assembly is in a second state flexed relative to the first state and under loading.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like components throughout the several views, FIG. 1 shows an article of footwear 10 that has a sole assembly 12. The article of footwear 10 may include a footwear upper 14 attached to the sole assembly 12 and dimensioned according to a specific size chart for a human foot 45. As shown, the article of footwear 10 is an athletic shoe, such as for running track and field. In other embodiments, the article of footwear 10 could be a dress shoe, a work shoe, a sandal, a slipper, a boot, or any other category of footwear. The article of footwear 10 has a heel portion 16, a midfoot portion 18, and a forefoot portion 20. The heel portion 16 generally corresponds with rear portions of a human foot 45 of the size of the article of footwear 10, including the calcaneus bone. The midfoot portion 18 generally corresponds with an arch area of the human foot 45 of the size of the article of footwear 12. The forefoot portion 20 generally corresponds with the toes and the joints connecting the metatarsals with the phalanges of the human foot 45 of the size of article of footwear 12.

The sole assembly 12 includes multiple components. For example, the sole assembly 12 may include a resilient midsole layer 22 attached to and positioned under the footwear upper 14 when the sole assembly 12 is resting on a level plane of the ground plane G. The midsole layer 22 may be a material that combines a desired level of resiliency and support, such as an ethylene vinyl acetate (EVA) foam. One or more midsole layers may be included in the article of footwear. An outsole layer or discreet outsole elements of a durable material such as rubber may be secured to an underside of the midsole layer 22 for traction and durability at least partially forming a ground contact surface of the article of footwear 10. Polymeric bladder elements defining fluid-filled cavities, such as air-filled cavities, can also be included in the sole assembly 12.

A strobel unit 24 can be bonded to a foot-receiving surface of the midsole layer 22. A lower periphery of the footwear upper 14 can be stitched or bonded to the strobel unit 24 and additionally or alternatively bonded to the midsole layer 22. In one embodiment, the strobel unit 24 can be an integral portion of a unitary, one-piece footwear upper 14, such as a one-piece knit upper stitched to form.

The sole assembly 12 includes a curved spring plate 26 generally in the forefoot portion 20. As further discussed herein, the curved spring plate 26 is configured to store energy as the forefoot portion 20 is flexed during forward movement prior to toe-off, and to release the energy to help propel the article of footwear 10 forward as the forefoot portion 20 unflexes during toe-off from the ground plane G. The curved spring plate 26 has a center portion 28 and opposite end portions 30, 32 extending from the center portion 28. The end portion 30 is a first end portion and may be referred to as a forward end portion as it is positioned forward of the center portion 28 along a longitudinal axis L of the article of footwear 10. The end portion 32 is a second end portion and may be referred to as a rearward end portion as it is positioned rearward of the center portion 28 along the longitudinal axis L.

Figure 5:
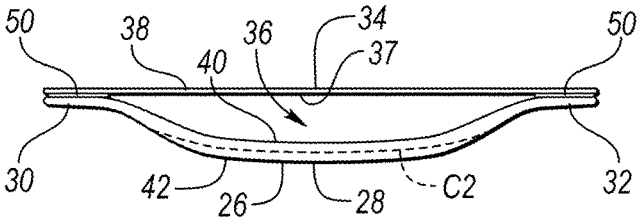
FIG. 5 is a schematic side view illustration of the spring plate of FIG. 4 with a retaining member secured to the spring plate to reverse the curvature of the spring plate to a second curvature.

The sole assembly 12 also includes a retaining member 34 secured on one side 37 to the end portions 30, 32 such that the retaining member 34 spans across and bows the center portion 28. The strobel unit 24 is secured to an opposite side 38 of the retaining member 34 as shown in FIG. 1, such as with adhesive. As best shown in FIG. 5, the retaining member 34 is secured only to the first and second end portions 30, 32 of the curved spring plate 26, such as by bonding with adhesive 50. In another embodiment, a mechanical lock or an interference locking system may be used to secure the retaining member to the spring plate. In such an embodiment, mechanical anchors secure the retaining member to the spring plate, with each anchor extending through the retaining member and through a respective slot in the spring plate. A void 36, also referred to herein as a cavity, exists between the center portion 28 of the spring plate 26 and the retaining member 34. The void 36 may be an unpressurized, unsealed, air-filled cavity.

The retaining member 34 is an inextensible and incompressible material, such as a polymeric woven fabric. The curved spring plate 26 is also an inextensible and incompressible material, such as a fiber strand-laid composite, including a carbon-fiber composite material, or may be a thermoplastic elastomer, such as polyether block amide (PEBAX), or a glass-reinforced nylon material. One suitable carbon-fiber composite material may be a carbon-fiber reinforced polymer with a binding polymer that can be a thermoset or thermoplastic polymer. Alternatively, the spring plate 26 may be a laminated wood, tempered steel, spring steel, or other suitable material as defined herein. The spring plate 26 may have a laminated construction. In other words, the spring plate 26 may be comprised of thin layers of any such suitable material.

Figure 4:
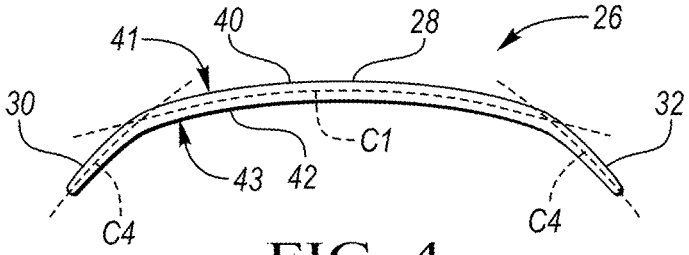
FIG. 4 is a schematic side view illustration of the spring plate of FIG. 1 with a first curvature as formed.
Figure 8:
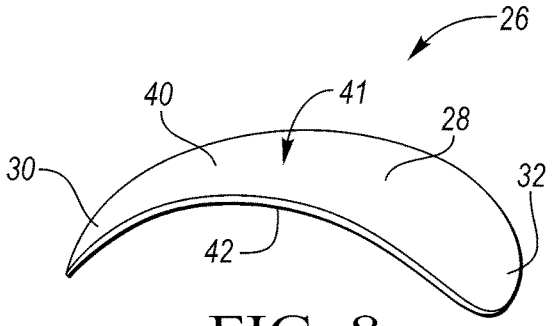
FIG. 8 is a schematic illustration in perspective view of the spring plate as formed having the first curvature of FIG. 4.

As shown in FIG. 4, the curved spring plate 26 is formed so that the center portion 28 has a first curvature C1. In other words, in a free-standing, unassembled state, as molded or otherwise formed and prior to securing the retaining member 34 to the curved spring plate 26, the curved spring plate 26 generally bows outward on a first side 40, and the end portions 30, 32 have a greater curvature C4 than the center portion 28. FIG. 8 is a perspective view of the curved spring plate 26 in the unassembled state. The first curvature C1 is also referred to as a pre-assembly curvature.

Figure 7:
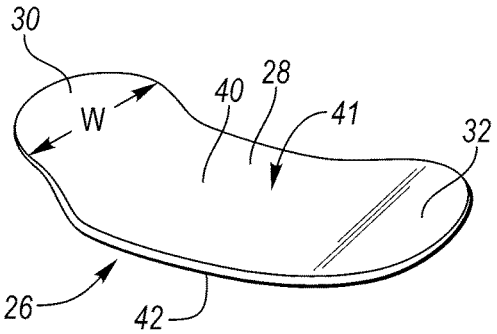
FIG. 7 is a schematic illustration in perspective view of the spring plate of FIG. 5, with the retaining member not shown, and having the second curvature of FIG. 5.

FIG. 4 shows that the spring plate 26 has a first surface 41 on the first side 40 and a second surface 43 on an opposing second side 42. As shown in FIG. 5, when the retaining member 34 is secured to the end portions 30, 32 on the first surface 41 of the first side 40, the end portions 30, 32 are pulled upward relative to their positions in FIG. 4, and the curvature of the center portion 28 is thereby reversed in direction so that the center portion 28 has a second curvature C2, in which the curved spring plate 26 generally bows outward on the second side 42. FIG. 5 represents the spring plate 26 and retaining member 34 in a first state, also referred to herein as an unflexed state, in which the forefoot portion 20 is in the unflexed position of FIG. 1 as the foot 45 is generally not flexed. The curved spring plate 26 is biased to return to its unassembled, as-formed state of FIG. 4, which places the retaining member 34 under tension. For purposes of illustration only, FIG. 7 shows the spring plate 26 in the position of FIG. 5, with the second curvature C2, although it would not remain in this position as shown without the retaining member 34 secured to the first surface 41.

Figure 2:
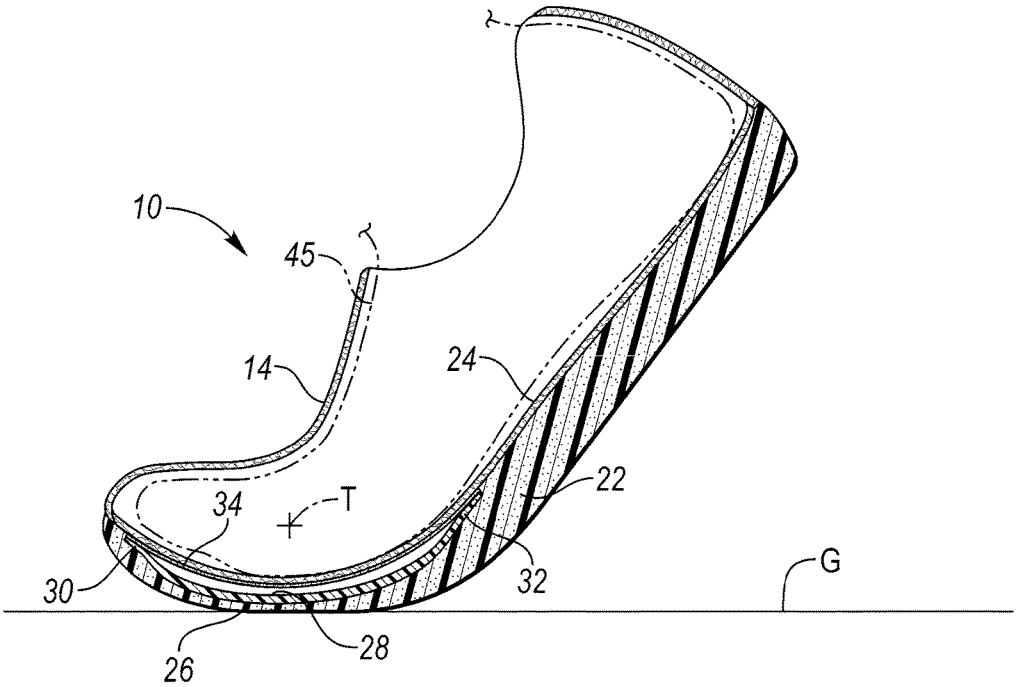
FIG. 2 is a schematic cross-sectional illustration of the article of footwear of FIG. 1 in a flexed and fully loaded position just prior to toe-off.
Figure 3:
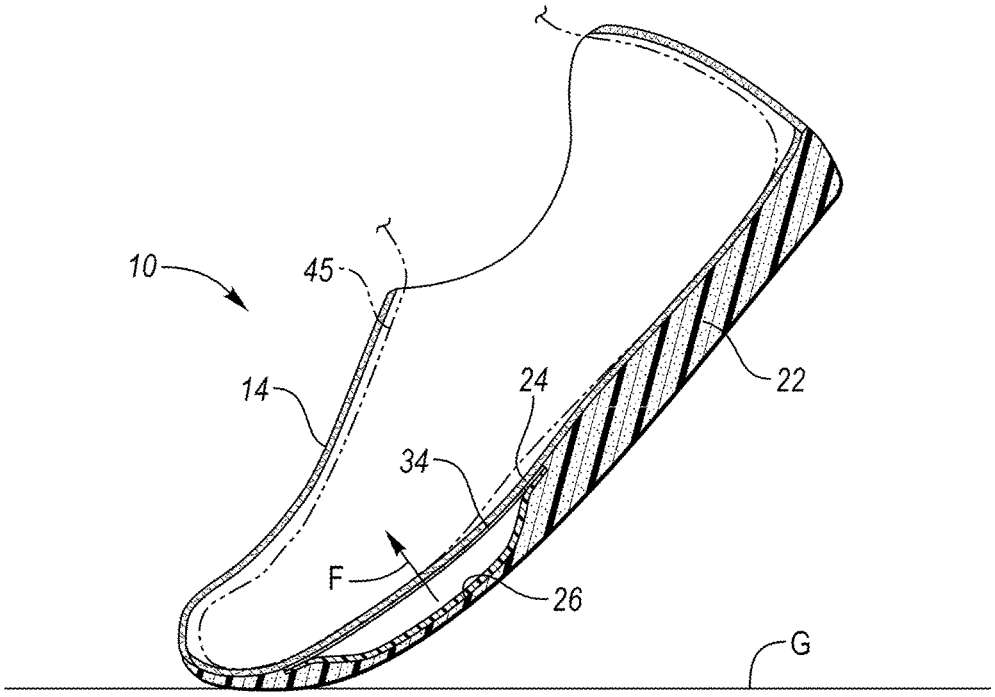
FIG. 3 is a schematic cross-sectional illustration of the article of footwear of FIG. 1 unflexing to a toe-off position with the spring plate releasing stored energy.
Figure 6:
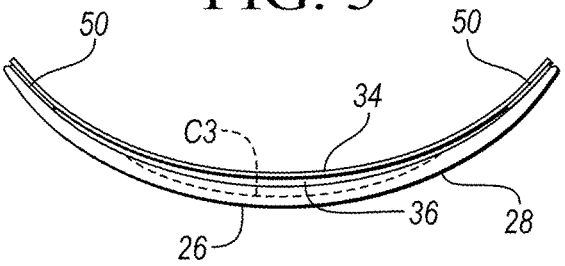
FIG. 6 is a schematic side view illustration of the spring plate of FIGS. 4 and 5 with the retaining member and the spring plate flexed under loading so that the spring plate has a third curvature.

The curved spring plate 26 is configured so that the center portion 28 has a first bending stiffness which is less than a second bending stiffness of the end portions 30, 32, where bending is about an axis T, shown in FIG. 2, that extends transversely in the article of footwear 10 and is perpendicular to the longitudinal axis L. When the foot 45 of a wearer of the article of footwear 10 is flexed so that the forefoot portion 20 is also flexed about the axis T, as shown in FIG. 2, prior to a final toe-off position of FIG. 3, additional loading is placed on the retaining member 34 and the spring plate 26 as the weight of the wearer shifts to the forefoot portion 20. The loading and flexing of the forefoot portion 20 causes both the retaining member 34 and the curved spring plate 26 to bend (i.e., flex) as shown in FIGS. 2 and 6 to a second state in which the center portion 28 has a third curvature C3 greater than the second curvature C2. Because the bending stiffness of the center portion 28 is less than the bending stiffness of the end portions 30, 32, the center portion 28 tends to flatten and the end portions 30, 32 are pulled inward toward the axis T under the loading. The retaining member 34 also flexes and moves toward the spring plate 26, closer to the center portion 28, causing the void 36 to decrease in height (as measured perpendicular to the ground plane G in the figures), as best shown in FIGS. 2 and 6.

The energy that is required to flex the spring plate 26 to the position of FIG. 2 is stored in the flexed spring plate 26, which is biased to return to the position of FIG. 1. In fact, the spring plate 26 is biased to return to the position of FIG. 4, but cannot do so when secured to the retaining member 34 and the midsole layer 22. As the article of footwear 10 continues to roll forward to the toe-off position of FIG. 3, the wearer lifts his weight, allowing the spring plate 26 to unflex to the position of FIGS. 3 and 5, with the center portion 28 returning to the second curvature C2, and the end portions 30, 32 moving relatively outward from the center portion 28. The released stored energy of the spring plate 26 results in a net released spring force F in the direction shown in FIG. 3. The released force F has a forward component (i.e., a component in a direction to the left in FIG. 3), and thus helps to propel the article of footwear 10 forward.

Figure 9:
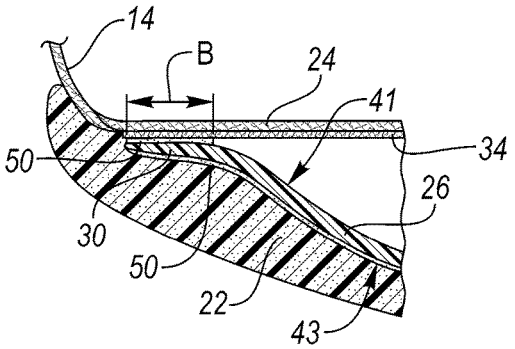
FIG. 9 is a schematic illustration in fragmentary cross-sectional view of a portion of the sole assembly of FIG. 1.

FIG. 9 is a detailed fragmentary view of a manner of securing the retaining member 34 and the midsole layer 22 to the spring plate 26. The retaining member 34 is bonded to the first surface 41 at the first end portion 30 with adhesive 50. The adhesive 50 establishes a bond margin B extending sufficiently in the longitudinal direction along the longitudinal axis L (indicated in FIG. 1), and across the width W of the spring plate 26 (indicated in FIG. 7) to secure the retaining member 34 to the spring plate 26. The retaining member 34 is similarly adhered to the second end portion 32. The adhesive 50 has a bonding strength, such as a sheer bonding strength, that is sufficiently high to overcome the biasing forces exerted by the spring plate 26 to return to the pre-assembled state with the first curvature C1, the adhesive 50 thereby maintaining securement of the retaining member 34 to the spring plate 26. In lieu of adhesive, any other attachment mode or mechanism sufficient to secure the retaining member 34 to the end portions 30, 32 may be used. In lieu of adhesive, the mechanical lock or the interference locking system described herein may be used to secure the retaining member 34 to the spring plate 26. Adhesive 50 also secures the entire second surface 43 to the midsole layer 22. The strobel unit 24 is adhered to the retaining member 34 and to the upper 14.

Figure 10:
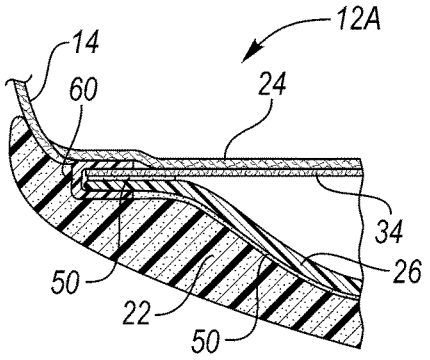
FIG. 10 is a schematic illustration in fragmentary cross-sectional view of a portion of an alternative embodiment of a sole assembly with the spring plate of FIG. 1 in accordance with an alternative aspect of the present teachings.
Figure 11:
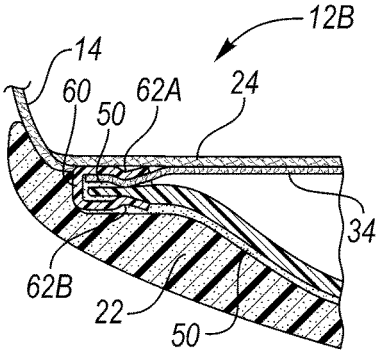
FIG. 11 is a schematic illustration in fragmentary cross-sectional view of a portion of another alternative embodiment of a sole assembly with the spring plate of FIG. 1 in accordance with another alternative aspect of the present teachings.

In FIG. 10, an alternative embodiment of a sole assembly 12A for the article of footwear 10 has a clip 60 that further secures the retaining member 34 to the spring plate 26 at the first end portion 30. Additional similar clips 60 can be used at the first end portion 30. One or more clips 60 can also secure the retaining member 34 to the second end portion 32. FIG. 11 shows another alternative embodiment of a sole assembly 12B for the article of footwear 10 in which the clip 60 is crimped at crimped sections 32A, 32B to further secure the clip 60 to the retaining member 34 and the first end portion 30. Any clip used at the second end portion 32 may also be crimped.

Figure 12:
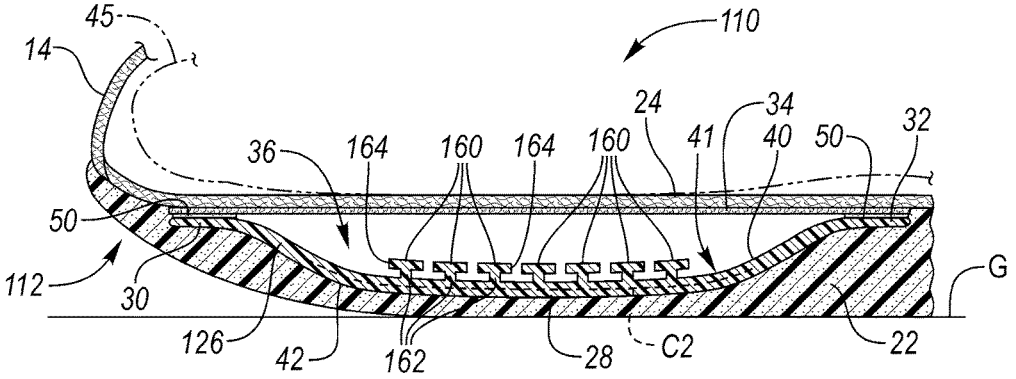
FIG. 12 is a schematic illustration in fragmentary cross-sectional view of an alternative embodiment of an article of footwear having a spring plate and in an unflexed position.
Figure 14:
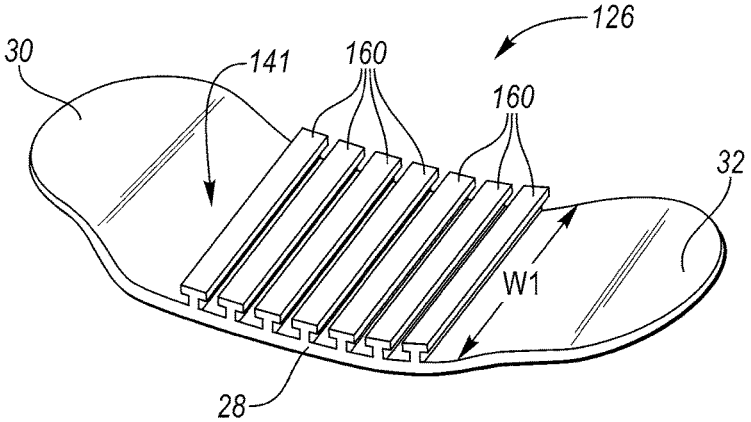
FIG. 14 is a schematic illustration in perspective view of the spring plate of FIG. 12 with the retaining member not shown and illustrating a curvature when in the unflexed position.

FIG. 12 shows another embodiment of an article of footwear 110 that is configured as described with respect to the article of footwear 10 except that a sole assembly 112 has an alternative spring plate 126 that includes protrusions 160 extending from the first surface 41 of the first side 40 of the spring plate 126. The protrusions 160 extend into the void 36 defined between the retaining member 34 and the spring plate 126. As best shown in FIG. 14, each protrusion 160 extends transversely across a width W1 of the spring plate 126. Alternatively, some or all of the protrusions 160 may extend only partway across the width W1 of the spring plate 126 so long as the protrusions 160 still interfere with one another to limit flexing. Each protrusion is generally T-shaped in side view and in the cross-sectional view of FIG. 12, taken along a longitudinal axis of the article of footwear 110. Each protrusion 160 has a neck 162 and a head 164 at a terminal end of the neck 162. The head 164 extends generally perpendicularly to the neck 162. If the retaining member 34 were removed, the spring plate 126 would have a first curvature in an unassembled, as-formed state as described with respect to the spring plate 26. In the unassembled state, the first curvature (i.e., the pre-assembly curvature) of the center portion 28 is the same as curvature C1 as shown in FIG. 4, and the end portions 30, 32 will have the same curvature C4 as shown in FIG. 4. The protrusions 160 will be splayed further apart from one another when the center portion 28 has the first curvature, as the first side 40 will appear convex in profile, similar to FIG. 8. The protrusions 160 can be integrally-formed with the spring plate 126, as in the embodiment shown, such as by compression molding or injection molding. Alternatively, the protrusions 160 can be a single, separate component that is compression or injection molded as a unit and adhered to the first side 40 of the spring plate 126 at the center portion 28. In another alternative embodiment, each protrusion 160 could instead be an individual, separate component secured to the first side 40 of the spring plate 126 at the center portion 28. In one embodiment, the spring plate 126 is a fiber strand-laid composite plate, such as a carbon-fiber composite material, and the protrusions 160 are a molded plastic component adhered to the first side 40 of the spring plate 126 at the center portion 28.

Figure 13:
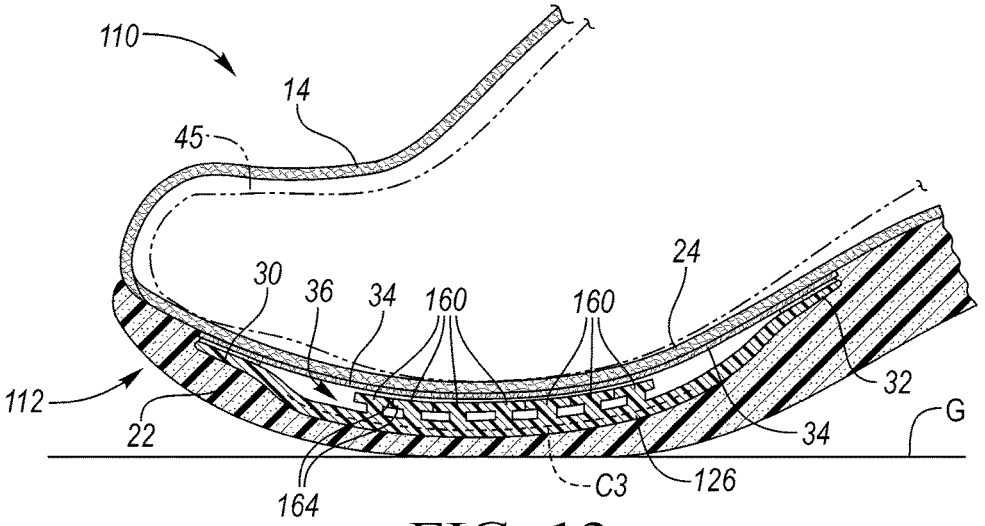
FIG. 13 is a schematic illustration in fragmentary cross-sectional view of the article of footwear of FIG. 12 in a flexed and fully loaded position prior to toe-off.

The protrusions 160 are configured to be spaced from one another when the center portion 28 has the second curvature of FIG. 12. That is, when the article of footwear 110 and the spring plate 126 are in the unflexed position of FIG. 12, adjacent ones of the protrusions 160 do not contact one another. When the article of footwear 110 is flexed to a fully-loaded position of FIG. 13 prior to toe-off, flexing of the spring plate 126 to increase the curvature of the center portion 28 from curvature C2 to curvature C3 causes the adjacent protrusions 160 to contact one another. As shown in FIG. 13, the adjacent heads 164 contact one another and interfere with further flexing of the spring plate 126. In other words, additional flexing (i.e., bending) of the center portion 28 beyond the third curvature C3 of FIG. 13 is made more difficult by the interference of the protrusions 160 with one another. The protrusions 160 thus act as stop-limiters to limit flexing by increasing resistance to further flexing of the spring plate 126 beyond the position of FIG. 13. As described with respect to spring plate 26, as the article of footwear 110 continues to roll forward to a toe-off position, the wearer lifts his weight, allowing the spring plate 126 to unflex, with the center portion 28 returning to the second curvature C2 of FIG. 12, and the end portions 30, 32 moving relatively outward from the center portion 28, so that the net released spring force has a forward component, and thus helps to propel the article of footwear 110 forward, as shown with respect to the article of footwear 10 in FIG. 3.

Figure 15:
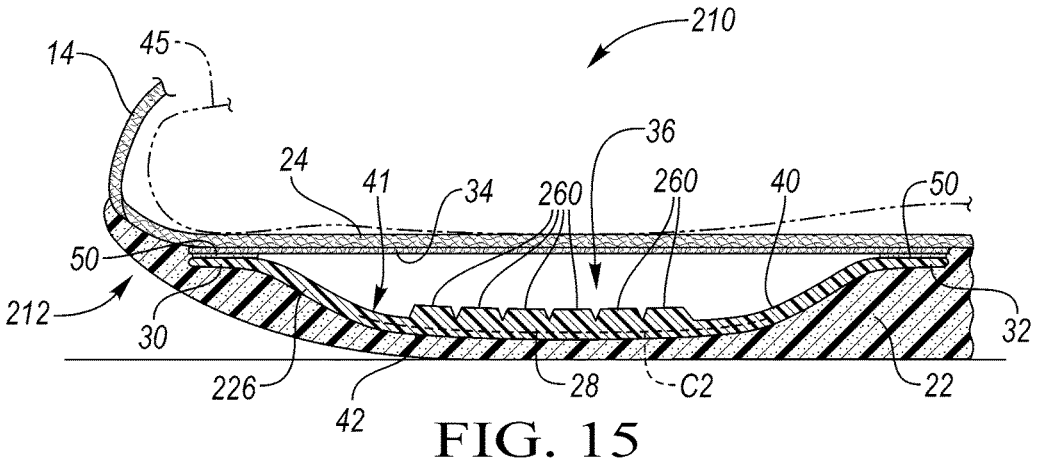
FIG. 15 is a schematic illustration in fragmentary cross-sectional view of another alternative embodiment of an article of footwear having a spring plate and in an unflexed position.
Figure 17:
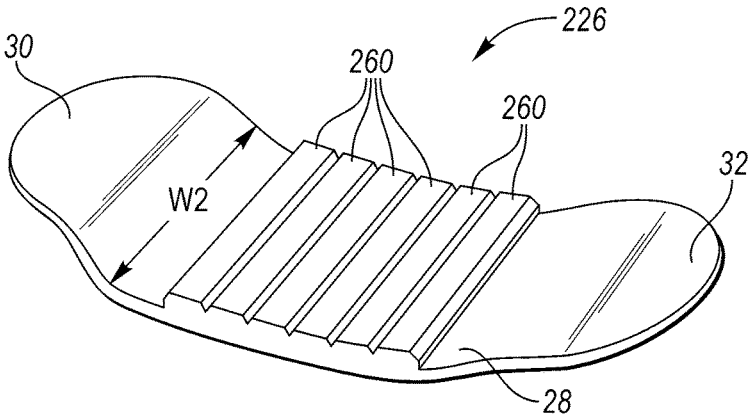
FIG. 17 is a schematic illustration in perspective view of the spring plate of FIG. 15 with the retaining member not shown and illustrating a curvature when in the unflexed position.

FIG. 15 shows another embodiment of an article of footwear 210 that is configured as described with respect to the article of footwear 10 except that a sole assembly 212 has an alternative spring plate 226 that includes protrusions 260 extending from the first surface 41 of the first side 40 of the spring plate 226. The protrusions 260 extend into the void 36 defined between the retaining member 34 and the spring plate 226. As best shown in FIG. 17, each protrusion 260 extends transversely across a width W2 of the spring plate 226. Alternatively, some or all of the protrusions 260 may extend only partway across the width W2 of the spring plate 226 so long as the protrusions 260 still interfere with one another to limit flexing. Each protrusion 260 tapers from the first surface 41 toward the retaining member 34. In the embodiment shown, each protrusion 260 has angled sides such that a V-shape is formed between adjacent protrusions 260 in side view and in the cross-sectional view of FIG. 15, taken along a longitudinal axis of the article of footwear 210. If the retaining member 34 were removed, as with the spring plate 26, the spring plate 226 would have a first curvature C1 in an unassembled, as-formed state. The first curvature (i.e., the pre-assembled curvature) of the center portion 28 is the same as curvature C1 as shown in FIG. 4, and the end portions 30, 32 will have the same curvature C4 as shown in FIG. 4. The protrusions 260 will be splayed further apart from one another when the center portion 28 has the first curvature, as the first side 40 will appear convex in profile, similar to FIG. 8.

The protrusions 260 can be integrally-formed with the spring plate 226, as in the embodiment shown, such as by compression molding or injection molding. Alternatively, the protrusions 260 can be a single, separate component that is compression or injection molded as a unit and adhered to the first side 40 of the spring plate 226 at the center portion 28. In another alternative embodiment, each protrusion 226 could instead be an individual, separate component secured to the first side 40 of the spring plate 226. In the embodiment of FIG. 15, the spring plate 226 is a fiber strand-laid composite plate, such as a carbon-fiber composite material, and the protrusions 260 are a single, separate molded plastic component adhered to the first side 40 of the spring plate 226 at the center portion 28.

Figure 16:
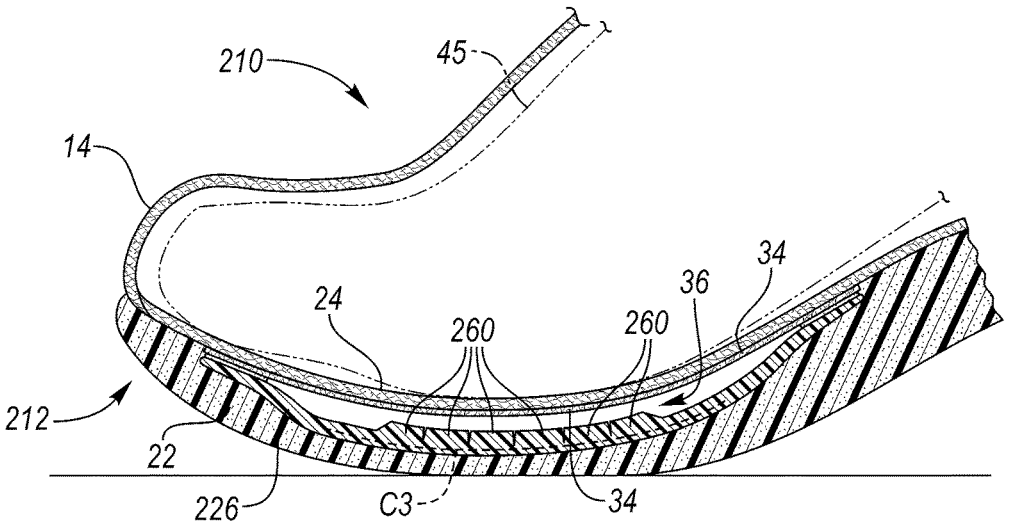
FIG. 16 is a schematic illustration in fragmentary cross-sectional view of the article of footwear of FIG. 15 in a flexed and fully loaded position prior to toe-off.

The protrusions 260 are configured to be spaced from one another when the center portion 28 has the second curvature of FIG. 15. That is, when the article of footwear 210 and the spring plate 226 are in the unflexed position of FIG. 15, adjacent ones of the protrusions 260 do not contact one another. When the article of footwear 210 is flexed as shown in FIG. 16 to a fully-loaded position prior to toe-off, flexing of the spring plate 226 to increase the curvature of the center portion 28 from curvature C2 to curvature C3 causes the adjacent protrusions 260 to contact one another. As shown in FIG. 16, the sides of the adjacent protrusions 260 contact one another and interfere with further flexing of the spring plate 226. In other words, additional flexing (i.e., bending) of the center portion 28 beyond the third curvature C3 of FIG. 15 is made more difficult by the interference of the protrusions 260 with one another. The protrusions 260 thus act as stop-limiters to limit flexing by increasing resistance to further flexing of the spring plate 226 beyond the position of FIG. 16. As described with respect to spring plate 26, as the article of footwear 210 continues to roll forward to a toe-off position like that of FIG. 3, the wearer lifts his weight, allowing the spring plate 226 to unflex, with the center portion 28 returning to the second curvature C2 of FIG. 15, and the end portions 30, 32 moving relatively outward from the center portion 28, so that the net released spring force has a forward component, and thus helps to propel the article of footwear 210 forward, as shown with respect to the article of footwear 10 in FIG. 3.

Although protrusions 160 that are T-shaped and protrusions 260 that taper toward the retaining member 34 are specifically shown and described, protrusions having other different shapes that interfere with one another when the center portion 28 flexes to have the third curvature C3 can be used within the scope of the present teachings. A clip 60 or multiple clips 60 like those of FIG. 10 or FIG. 11 can be used to further secure the retaining member 34 to the spring plate 126 or 226 of the respective sole assembly 112 or 212.

While several modes for carrying out the many aspects of the present teachings have been described in detail, those familiar with the art to which these teachings relate will recognize various alternative aspects for practicing the present teachings that are within the scope of the appended claims.

What is claimed is:

1. A sole assembly for an article of footwear comprising:

a curved spring plate having a center portion and opposite end portions extending from the center portion, and having a top side with a first surface and a bottom side with a second surface, the bottom side opposing the top side; wherein the spring plate is internally biased toward a first curvature in which the top side is convex at the center portion and the bottom side is concave at the center portion;

a retaining member secured to the end portions such that the retaining member spans across the center portion, with the top side concave at the center portion and facing the retaining member and the bottom side convex at the center portion and facing away from the retaining member, the retaining member in tension due to the internally biased spring plate; and wherein flexing of the spring plate under loading of the sole assembly stores spring energy in the spring plate that urges the center portion to unflex and release the spring energy.

2. The sole assembly of claim 1, wherein the retaining member is secured to the first surface only at the end portions, and further comprising:

a sole layer secured to the second surface of the spring plate at the end portions and at the center portion.

3. The sole assembly of claim 1, wherein the spring plate and the retaining member define a void therebetween; and wherein the retaining member flexes toward the center portion of the spring plate as the spring plate flexes under loading to decrease the void.

4. The sole assembly of claim 3, wherein the void is between the center portion of the spring plate and the retaining member.

5. The sole assembly of claim 1, wherein the end portions are stiffer than the center portion.

6. The sole assembly of claim 1, wherein the center portion has a second curvature opposite from the first curvature when the spring plate is in an unflexed state; and wherein the center portion has a third curvature greater than the second curvature when the spring plate is in a flexed state under loading.

7. The sole assembly of claim 6, further comprising:

a plurality of protrusions extending from the first surface at the center portion; wherein the plurality of protrusions are configured to be spaced from one another when the center portion has the second curvature; and wherein adjacent ones of the plurality of protrusions are configured to contact one another when the center portion has the third curvature, thereby limiting flexing of the spring plate.

8. The sole assembly of claim 7, wherein at least one of the plurality of protrusions tapers toward the retaining member and extends transversely across the spring plate.

9. The sole assembly of claim 7, wherein at least one of the plurality of protrusions has a neck extending from the first surface and a head perpendicular to the neck at a terminal end of the neck; and wherein said at least one of the plurality of protrusions extends transversely across the spring plate.

10. The sole assembly of claim 1, wherein the retaining member is an inextensible fabric.

11. The sole assembly of claim 1, further comprising: a clip securing the retaining member to the spring plate at one of the end portions.

12. The sole assembly of claim 11, wherein the clip is crimped to the spring plate.

13. The sole assembly of claim 1, wherein the spring plate is a fiber strand-laid composite, a carbon-fiber composite, a thermoplastic elastomer, a glass-reinforced nylon, wood, tempered steel, or spring steel.

14. The sole assembly of claim 1 wherein the spring plate is laminated.

15. The sole assembly of claim 1, further comprising:

a sole layer secured to the second surface of the spring plate; wherein the sole layer has a forefoot portion, a midfoot portion, and a heel portion; and wherein the spring plate is secured to the forefoot portion of the sole layer with a first one of the end portions forward of a second one of the end portions.

16. A sole assembly for an article of footwear comprising:

a midsole layer having a forefoot portion, a midfoot portion, and a heel portion arranged along a longitudinal axis of the midsole layer;

a curved plate having a top side with a first surface and a bottom side with a second surface, with the bottom side supported on and secured to the forefoot portion of the midsole layer and the top side opposite from the bottom side; wherein the curved plate has a center portion and first and second end portions extending from the center portion along the longitudinal axis; wherein the curved plate is internally biased toward a first curvature in which the top side is convex at the center portion and the bottom side is concave at the center portion; wherein the center portion has a first bending stiffness and the first and second end portions each have a respective bending stiffness greater than the first bending stiffness;

an inextensible retaining member secured to the first and second end portions and spanning across and bowing the center portion to a second curvature with the top side concave at the center portion and facing the retaining member, and the bottom side convex at the center portion and facing away from the retaining member, the retaining member in tension due to the internally biased curved plate; wherein the center portion and the retaining member define a void therebetween; and wherein loading of the curved plate and the retaining member when the forefoot portion is flexed stores energy in the curved plate that is released as the forefoot portion unflexes.

17. The sole assembly of claim 16, wherein the center portion has a third curvature greater than the second curvature when the sole assembly is flexed and is under loading.

18. The sole assembly of claim 17, further comprising:

a plurality of protrusions extending from the first surface at the center portion; wherein the plurality of protrusions are configured to be spaced from one another when the center portion has the second curvature; and wherein adjacent ones of the plurality of protrusions are configured to contact one another when the center portion has the third curvature, thereby limiting flexing of the curved plate.

19. The sole assembly of claim 18, wherein at least one of the plurality of protrusions tapers toward the retaining member and extends transversely across the curved plate.

20. The sole assembly of claim 18, wherein at least one of the plurality of protrusions has a neck extending from the first surface and a head perpendicular to the neck at a terminal end of the neck; and wherein said at least one of the plurality of protrusions extends transversely across the curved plate.

* * * * *